US008398389B2

(12) United States Patent
Stündl

(10) Patent No.: US 8,398,389 B2
(45) Date of Patent: Mar. 19, 2013

(54) METHOD AND APPARATUS FOR MANUFACTURING A CRIMPED COMPOUND THREAD

(75) Inventor: Mathias Stündl, Wedel (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 705 days.

(21) Appl. No.: 11/833,434

(22) Filed: Aug. 3, 2007

(65) Prior Publication Data

US 2008/0041030 A1 Feb. 21, 2008

Related U.S. Application Data

(63) Continuation of application No. PCT/EP2005/005969, filed on Jun. 3, 2005.

(30) Foreign Application Priority Data

Feb. 4, 2005 (DE) ..... 10 2005 004 984

(51) Int. Cl.
*B28B 5/00* (2006.01)

(52) U.S. Cl. ..... 425/72.2

(58) Field of Classification Search ..... 425/66, 425/72.2

See application file for complete search history.

(56) References Cited

U.S. PATENT DOCUMENTS

| | | | | |
|---|---|---|---|---|
| 5,251,363 | A * | 10/1993 | Gerhards et al. | 28/221 |
| 6,119,320 | A * | 9/2000 | Weiss | 28/221 |
| 6,120,715 | A * | 9/2000 | Weigend | 264/103 |

FOREIGN PATENT DOCUMENTS

| | | | |
|---|---|---|---|
| DE | 4 202 896 | A1 | 8/1992 |
| DE | 10 2004 007 073 | A1 | 2/2004 |
| EP | 0 485 871 | A1 | 5/1992 |
| EP | 0 488 070 | A1 | 6/1992 |
| EP | 0 874 072 | A1 | 10/1998 |
| WO | WO 03/064743 | A1 | 8/2003 |
| WO | WO 2004/018750 | A1 | 3/2004 |
| WO | WO 2004/018751 | A1 | 3/2004 |

OTHER PUBLICATIONS

The International Search Report for International Appl. No. PCT/EP2005/005969, completed Sep. 21, 2005.

The International Preliminary Report on Patentability for International Appl. No. PCT/EP2005/005969, completed Aug. 14, 2007.

The Written Opinion for International Appl. No. PCT/EP2005/005969, mailed Sep. 29, 2005.

* cited by examiner

*Primary Examiner* — Larry Thrower
(74) *Attorney, Agent, or Firm* — Alston & Bird LLP

(57) ABSTRACT

The invention relates to a method and a device for producing a crimped composite thread, wherein the inventive method consists in extruding, cooling and in drawing several yarns in the form of a plurality of strand filaments and in jointly crimping them in order to obtain a crimped composite thread. The aim of said invention is to make it possible to pre-treat the threads in a manner adaptable to each treatment step. The aim is attained by that at least one multi-treaded yarn is whirl-tangled many times during several operations prior to crimping. For this purpose, a whirl-tangling device provided with a plurality of whirl-tangling units following each other in a direction of the yarn displacement is used.

11 Claims, 5 Drawing Sheets

METHOD AND APPARATUS FOR MANUFACTURING A CRIMPED COMPOUND THREAD

CROSS-REFERENCE TO RELATED APPLICATIONS

The present application is a Continuation of International Application No. PCT/EP2005/005969, filed Jun. 3, 2005, and which designates the U.S. The disclosure of the referenced application is incorporated herein by reference.

FIELD OF THE INVENTION

The invention relates to a method for manufacturing a crimped compound thread, and an apparatus for carrying out said method.

BACKGROUND OF THE INVENTION

In a method of manufacturing a crimped compound thread in a single-stage process, first a plurality of synthetic individual threads are produced by extruding a plurality of filament strands, cooling these, and drawing (stretching) them. The individual threads have different characteristics, in particular they may have different colors, so that the coloration of the compound thread depends on the combination of the individual threads. For different applications, the requirements for the appearance (particularly coloration) of the compound thread will differ. It may be particularly desirable to have a compound thread appearance wherein the separate threads do not dominate, but wherein there is not complete mixture of the threads. The dominance of a given color component in the compound thread, if too long (comprising a long segment of the compound thread in which one color dominates), may lead to so-called "flames". However, often such "flames" are in fact desirable.

EP 0485871A1 discloses a method and apparatus for manufacturing a multicolored compound thread, which method and apparatus have proven to be particularly useful for producing so-called "tricolor threads" for use in carpets. Here a compound thread is produced from multifilament individual threads by common crimping. To achieve such crimping, the individual threads are introduced together into a crimping chamber with the aid of an advancing nozzle. In the crimping chamber, the filaments of the individual threads are laid down into bends and loops, wherewith a common thread plug is formed. Along with the crimping, a certain intermingling of the filaments of the individual threads occurs.

To promote a certain color separation in the compound thread, each of the individual threads is separately subjected to whirl-tangling prior to the crimping, so that the interlacing of filaments in a given thread provides thread cohesion of the component thread. In this way, the intermingling of the individual threads in the compound thread can be improved with regard to color separation. In practice it is desirable to have the color characteristics of the compound thread controllable such that it is possible to manufacture a compound thread with a mixed color wherein the individual threads are intensively intermingled, or to manufacture a compound thread with strong color separation properties wherein the individual threads are not intensively intermingled.

EP 0874072 A1 discloses a method and apparatus wherein the individual threads are separately subjected to whirl-tangling and are separately crimped, prior to combining them to form the compound thread. A basic drawback of this method is that the separation in the compound thread is too pronounced, which is undesirable if one seeks to avoid the appearance of so-called "flames" in a carpet. A further drawback is that the individual threads must be separately crimped, substantially increasing equipment costs, and complicating the process (rendering it more subject to problems) in the case of a multi-thread apparatus.

DE 4202896 A1 discloses another method and apparatus, wherein the individual threads are given a "false twist" before being fed into the crimping device. This creates a risk that certain individual threads will be too dominant in the compound thread, and further that the crimping (texturizing) effect in the individual threads will be hindered.

An underlying problem of the present invention was to devise a refined method and apparatus of the type described initially supra, which enable maximum flexibility to attain particular color effects in the compound thread, in the range from mixed colors to highly separated colors.

A second underlying problem was to enable reproducible adjustability of the color appearance of the compound thread.

SUMMARY OF THE INVENTION

These problems are solved according to the invention by a method described herein, and an apparatus described herein.

Advantageous refinements of the invention are set forth in the features and combinations of features of the various embodiments described herein.

The invention is based on the concept that one can achieve very wide-ranging effects with the appropriate application of whirl-tangling of multifilament threads. E.g., by whirl-tangling a multifilament thread one can achieve intermingling or snarling of the filaments of the thread. This determines the intensity of the thread cohesion, depending on the stage of treatment of the thread. According to the invention, at least one of the multifilament threads is subjected to multiple whirl-tanglings. In particular, at least one of the multifilament individual threads is subjected to whirl-tangling a plurality of times, in a plurality of pre-treatment stages, to provide a desired filament cohesion, prior to the crimping of the individual threads. Another advantage of the invention is that the common texturizing of the individual threads can be retained in the compound thread. The multiple whirl-tangling of the individual threads enables the coloration of the compound thread to be varied within wide limits not attainable by other methods. Thus, if one seeks a high degree of color separation one will subject each of the individual threads to whirl-tangling in a number of pre-treatment stages. If one seeks the appearance of mixed coloration in the compound thread, one will preferably subject only one of the multifilament individual threads to whirl-tangling (in a plurality of pre-treatment stages).

The variant method according to which each of the multifilament individual threads is separately subjected to whirl-tangling in a first pre-treatment stage prior to drawing is distinguished in that the individual threads can be passed through the drawing device very smoothly, and disposed very close together. In this connection, the whirl-tangling of the individual threads in the first pretreatment stage can be adjusted to achieve an optimum degree of filament cohesion for the drawing of the individual threads.

In order to achieve special effects in the nature of mixing or separation of colors in the compound thread, according to a preferred variant of the method at least one of the individual threads is, or all of said threads are, subjected separately to whirl-tangling in a second pre-treatment stage following the stretching. In this way, the filament cohesion brought about via the whirl-tangling of the individual threads can be adjusted specifically for the subsequent common crimping of the individual threads.

The adjustability and range of variability of the coloration of may be improved if, in at least one of the pre-treatment stages, whirl-tangling is carried out on the individual threads, wherewith the set-point values of the compressed air in the compressed air feed are at respective different values for the different threads. In this way, one can provide different degrees of whirl-tangling in different parallel advanced individual threads. E.g. if it is desired to produce a compound thread wherein in addition to a dominant individual thread a second component is present which contributes a mixing color, the individual thread having the color-determining contribution may be subjected to whirl-tangling with a relatively high set-point value of the compressed air. It turns out that this value is proportional to the points of intermingling ("intermingling knots") in the thread.

It is also possible to carry out whirl-tangling of the individual threads in the pre-treatment stages wherewith the set-point values of the compressed air in the compressed air feed are at respective different values for different such stages. Thus, e.g. for the drawing process the thread should have a relatively low filament cohesion, in order not to inhibit the stretching of the individual filaments. In contrast, for the common crimping of the individual threads it is desirable for the whirl-tangling to be adjusted for the desired color characteristics.

Also, it is possible to carry out whirl-tangling with pulsation of the pressure, e.g. in the second pre-treatment stage, in order to vary the mixing of the colors. This also enables the creation of special yarn effects for manufacture of "fancy yarns".

In order to intensify the whirl-tangling treatment prior to the crimping of the individual threads, it has been found advantageous to employ a variant method according to which the multifilament individual threads are subjected to whirl-tangling with the aid of heated compressed air. Alternatively, the individual threads may be heated prior to the whirl-tangling. This has been found to exert influence on the intermingling of the filaments in the individual threads, and on the crimping of the compound thread.

In order to provide appreciable tension in the threads at the point of the crimping of the individual threads, independently of the tension in the threads in the course of the preceding stage(s) of whirl-tangling, according to a variant method it is advantageous if, prior to the crimping, the individual threads are passed multiple times around a galette unit, and are subjected to whirl-tangling in a thread segment of the resulting loops in said galette unit, prior to leaving the galette unit.

If one employs heated galettes, one may advantageously accomplish temperature-controlled simultaneous whirl-tangling of the individual threads.

In order to achieve the thread cohesion necessary for final processing of the compound thread, the compound thread is subjected to tangling after the crimping of the individual threads and prior to the winding onto a bobbin, wherewith the coloration of the compound thread which has been imparted in the pre-treatment stages and via the crimping of the individual threads is substantially preserved.

The inventive method is particularly well suited to the manufacture of a compound thread comprised of a plurality of component threads each of which preferably is different. However, the scope of the invention is not limited to situations with component threads having different characteristics, in light of the fact that, in particular, individual pre-treatment of identical individual threads can advantageously be employed to produce a compound thread. E.g., the individual threads may be given specific structural properties in the course of pretreatment by whirl-tangling in two different stages.

In another advantageous variant of the inventive method, the individual threads undergo separate whirl-tangling in a first stage of pre-treatment and then all of them undergo a common whirl-tangling in a second stage of pre-treatment. The multi-stage whirl-tangling prior to the texturizing according to the invention provides a very high degree of flexibility in the pre-treatment of the individual threads prior to said texturizing. Thus it is also possible to subject the individual threads to a common whirl-tangling in the first pre-treatment stage and to separate whirl-tangling in the second pre-treatment stage.

Further, the scope of the inventive method is not limited to situations with common crimping of the individual threads. It is basically also possible to separately texturize each of the individual threads, prior to combining them. In another possible method, texturizing of the individual threads (commonly or separately) and combining of the individual threads to form a compound thread are carried out, following which, after cooling, the compound thread is separated again into component threads, and then said threads are subjected to common whirl-tangling prior to winding as the final compound thread. Such a variant method may be employed with individual threads of different colorations, in order to achieve additional coloration effects.

The apparatus for carrying out the inventive method is comprised of a whirl-tangling device comprised of a plurality of whirl-tangling units which are disposed in succession in the path of advance of the individual threads.

In order to be able to carry out processing steps on the individual threads between the individual whirl-tangling steps, advantageously a first whirl-tangling unit is disposed upstream of the drawing device, wherewith said first whirl-tangling unit has a respective whirl-tangling nozzle for each of the individual threads.

Advantageously a second whirl-tangling unit having a plurality of whirl-tangling nozzles is disposed between the drawing device and the crimping device.

In order to be able to carry out the whirl-tangling of the individual threads in the individual pre-treatment stages with different set-point values of the compressed air pressure, each of the whirl-tangling nozzles has a controllable compressed air supply. In this connection, a plurality of whirl-tangling nozzles may simultaneously have a common compressed air supply, or one or more whirl-tangling nozzles may have separate compressed air supplies.

In order to obtain special effects which previously were obtained by thermal whirl-tangling, the inventive apparatus may be expanded to comprise heating means associated with at least one of the whirl-tangling units, whereby certain compressed air is heated.

Alternatively, a heating device may be provided upstream of the whirl-tangling unit, for heating the individual threads.

To achieve independent adjustment of thread tension in the whirl-tangling of the individual threads and in the crimping process, preferably in the inventive apparatus the drawing device is comprised of a galette unit disposed upstream of the crimping device, wherewith the individual threads are guided over said galette unit in multiple loops; and the whirl-tangling nozzles of a second whirl-tangling unit are arranged such that the individual threads can be subjected to whirl-tangling prior to leaving the galette unit.

If the whirl-tangling nozzles of the second whirl-tangling unit are disposed in a segment looped around galettes, which segment is between two galettes, namely in the last loop, the tension of the thread(s) in the whirl-tangling process can be reduced to a desired value if the individual threads at the point of leaving the galette unit are passed over a reduced diameter step in the galette. Basically any of the segments between the two galettes is acceptable as a location for disposing the whirl-tangling nozzles for carrying out whirl-tangling in the second pre-treatment stage.

In order to achieve additional thermal effects in the whirl-tangling of the filaments, according to an advantageous refinement of the invention the galette unit is comprised of at least two driven galettes, wherewith at least one of the galettes is configured so as to be heatable.

For final establishment of the thread cohesion in the compound thread, a tangling device is disposed between the crimping device and a winding device which is provided for winding the compound thread onto a bobbin or the like.

To provide intensive and uniform crimping of the individual threads, a variant apparatus been found to be particularly advantageous in which the crimping device comprises an advancing nozzle and an associated crimping chamber, wherewith the individual threads are advanced as a group into the crimping chamber by means of the advancing nozzle, wherewith a thread plug is formed.

BRIEF DESCRIPTION OF THE DRAWINGS

The inventive method will be described in more detail hereinbelow with the aid of an exemplary embodiment of the inventive apparatus, with reference to the accompanying drawings.

DETAILED DESCRIPTION OF PREFERRED EMBODIMENTS

Figure 1:
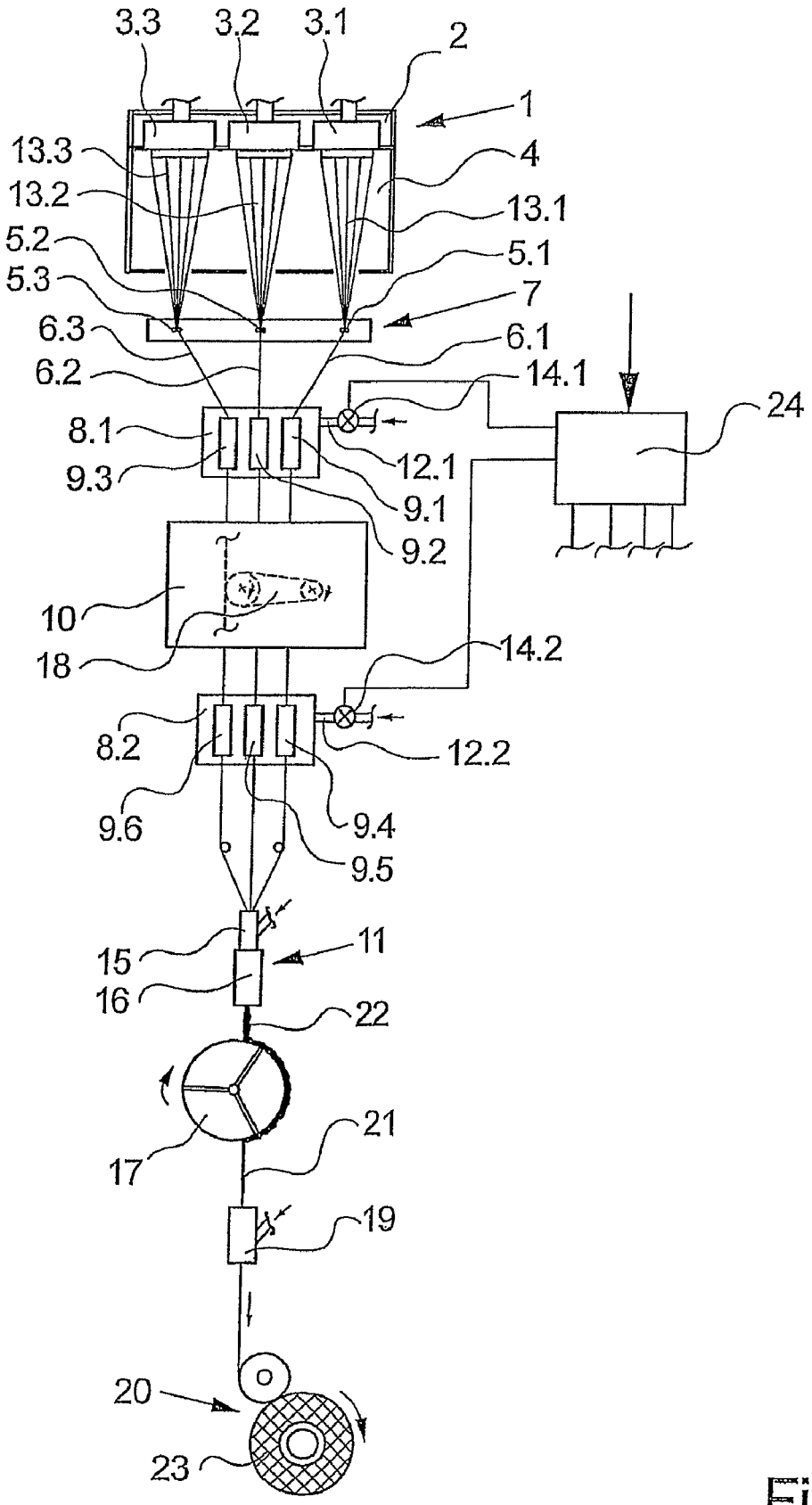
FIG. 1 is a schematic drawing of a first exemplary embodiment of the inventive apparatus for carrying out the inventive method.

FIG. 1 shows schematically an exemplary embodiment of an inventive apparatus for carrying out the inventive method. The apparatus has a spinning device 1 which is connected to one or more melters (not shown). The spinning device has a heated spinning frame 2 which bears a plurality of spinnerets ("spinning nozzles") (3.1-3.3) arrayed side by side. Each spinneret (3.1-3.3) has on its underside a plurality of orifices through which the polymer melt stream fed to said nozzle is extruded under pressure to form a respective individual filament. A cooling device 4 is disposed below the spinning device 1; the extruded filaments, which leave the spinning device at a temperature close to their melting temperature, are guided through the cooling device in order to cool said filaments. The cooling device 4 may comprise, e.g., a blower which blows cooling air essentially transversely against the filaments. After the filaments are cooled, the filament strands (13.1-13.3) associated with the respective spinnerets (3.1-3.3) are combined, at the exit of the cooling device 4, to form respective individual threads (6.1-6.3).

At the outlet of the cooling device 4, a "preparation device" 7 is provided, along with respective thread guides (5.1-5.3) for each of the individual threads (6.1-6.3).

To draw out the individual threads (6.1-6.3) from the spinnerets (3.1-3.3), a drawing device 10 is provided which comprises at least one galette device 18 (dashed lines) which is configured for drawing-out. The individual threads (6.1-6.3) are guided in parallel paths through the drawing device 10. In this, the individual threads can be drawn in a common arrangement, or individual delivery devices may be employed (one for each thread).

After the drawing-out and stretching of the individual threads (6.1-6.3) by the drawing device 10, the individual threads (6.1-6.3) are brought together in a crimping device 11 and combined to form a compound fiber 21.

In this exemplary embodiment, the crimping device 11 is comprised of an advancing nozzle 15 and a crimping chamber 16 which cooperates with the nozzle 15. The advancing nozzle 15 is connected to a pressure source (not shown) by means of which a conveying medium is fed to the advancing nozzle 15. The conveying medium causes the individual threads (6.1-6.3) to be drawn into the advancing nozzle 15 and then advanced into the crimping chamber 16 where they are formed into a "fiber plug". This involves a partial intermingling of the individual threads (6.1-6.3). The thread plug 22, which preferably is formed by means of a hot conveying medium, is then passed to a cooling drum 17 and cooled.

For pre-treatment of the individual threads (6.1-6.3), a first whirl-tangling unit 8.1 is provided between the preparation device 7 and the drawing device 10; and a second whirl-tangling unit 8.2 is provided between the drawing device 10 and the crimping device 11. The first whirl-tangling unit 8.1 has a plurality of whirl-tangling nozzles (9.1-9.3), each associated with a respective individual thread (6.1-6.3). Each whirl-tangling nozzle (9.1-9.3) has a thread channel through which the individual thread is guided. A pressure channel opens out laterally into the thread channel, to introduce a high energy compressed fluid, preferably compressed air, into the thread channel. The pressure channels are connected to a pressure source via a compressed air supply line 12.1 and pressure adjusting means 14.1. A control device 24 is provided, which is connected to the pressure adjusting means 14.1, for setting the set-point for control of the compressed air.

The structure and configuration of the whirl-tangling nozzles (9.1-9.3) is generally known, and is described in, e.g., DE 10 2004 007073 A1.

The second whirl-tangling unit 8.2 associated with the crimping device 11 also has a plurality of whirl-tangling nozzles (9.4-9.6), having a structure and configuration essentially identical to the structure and configuration of the whirl-tangling nozzles (9.1-9.3) of the first whirl-tangling unit 8.1. The whirl-tangling nozzles (9.4-9.6) are connected to a pressure source (not shown) via a compressed air supply line 12.2 and pressure adjusting means 14.2. The pressure adjusting means 14.2 are connected to the control device 24, for setting and varying the set-point for control of the compressed air. This allows the whirl-tangling units (8.1, 8.2) to be operated mutually independently in carrying out whirl-tangling of the threads (6.1-6.3).

For post-treatment of the crimped compound thread 21 produced from the individual threads (6.1-6.3), the crimping device 11 has disposed downstream of it a "tangling device" 19, inside which the compound thread 21 receives a final treatment required for the further processing.

Following this "tangling", the compound thread 21 is taken up on a winding device 20 wherewith it is wound on a bobbin or the like 23.

In the process, the winding device 20 serves simultaneously as a drawing organ, to draw the crimped compound thread 21 from the thread plug 22. In order to be able to adjust the tension in the compound thread 21 in the winding and in the "tangling", said thread may be drawn from the thread plug 22 by means of a galette device; and a second galette unit may be provided downstream of the "tangling device" 19, as the thread is passed to the winding device 20. The configurations of the devices in the post-treatment zone do not bear upon the invention—any suitable processing means and treatment stages may be chosen for influencing the compound thread 21 prior to winding onto the bobbin 23.

In the exemplary embodiment of the inventive apparatus illustrated in FIG. 1, three bundles of filaments (13.1-13.3) disposed side by side are spun in the spinnerets (3.1-3.3); each of these bundles has a plurality of filament strands. The filament bundles (13.1-13.3) may have different properties; preferably the basic polymers of which they are comprised have different colors. Indeed, the basic polymers may have different compositions or may contain different amounts of additives.

Each of the filament bundles (13.1-13.3) is combined to form an individual thread (6.1-6.3). For this purpose, the filament bundles (13.1-13.3) are subjected to addition of preparation agents by means of the preparation device 7, and are passed through the thread guides (5.1-5.3), from which the individual threads emerge.

For further treatment of the individual threads (6.1-6.3), in a first pre-treatment stage immediately following the "preparation" a first whirl-tangling is carried out, in whirl-tangling unit 8.1. For this, each individual thread (6.1-6.3) is passed through a whirl-tangling nozzle (9.1-9.3). The whirl-tangling unit 8.1 has a pressure set-point value for the compressed air which is supplied, which leads to intermingling (interlacing) of the filaments of which the individual threads are comprised. In this process, one achieves uniformization of the preparation, as well as the minimum filament cohesion required for the subsequent drawing by the galette in the drawing device 10. In the setting of the pressure set-point value, one should take care to avoid excessive snarling of the filaments of the individual threads.

After the individual threads (6.1-6.3) have been drawn out and stretched, a second whirl-tangling of said threads is carried out via the whirl-tangling unit 8.2, in the second pre-treatment stage. In this unit 8.2, the individual threads (6.1-6.3) are individually separately guided and whirled, by means of the whirl-tangling nozzles (9.4-9.6). In this process, the intermingling of the filaments in the individual threads (6.1-6.3) which is brought about is chosen such that a certain intermingling is achieved in the crimping of the individual threads (6.1-6.3) which are combined into the compound thread 21. In particular, in producing a multicolored crimped compound thread the coloration of the compound thread 21 can be influenced within wide bounds. Thus, e.g., a compound thread with strong color separation can be produced by setting the set-point value of the pressure of the compressed air supply in the second whirl-tangling unit 8.2 relatively high. This causes intensive intermingling of the filaments of the individual threads, wherewith the subsequent crimping process will not be able to substantially undo this intermingling. If the set-point value of the pressure in the whirl-tangling unit 8.2 is set relatively low, the compound thread 21 will have an appreciably mixed coloration.

After the whirl-tangling in the second pre-treatment stage, the individual threads (6.1-6.3) are jointly crimped and are combined to form the compound thread 21. In this process, the individual threads (6.1-6.3) are advanced through the advancing nozzle 15 by means of an advancing fluid, into an adjoining crimping chamber 16. In the crimping chamber 16, the filaments of the individual threads (6.1-6.3) are laid down into bends and loops in the course of formation of a thread plug 22, which is subjected to thermal treatment and is then opened to yield the crimped compound thread 21. To produce the final thread characteristics (thread cohesion, body, strength, etc.), the compound thread 21 undergoes "tangling" in the tangling device 19 prior to being wound on the bobbin 23.

The inventive method and apparatus may be employed to produce, e.g., multicolored crimped compound threads which have high color uniformity. If necessary or desirable, particular visual characteristics can be imparted by adjusting the pre-treatment.

Figure 2:
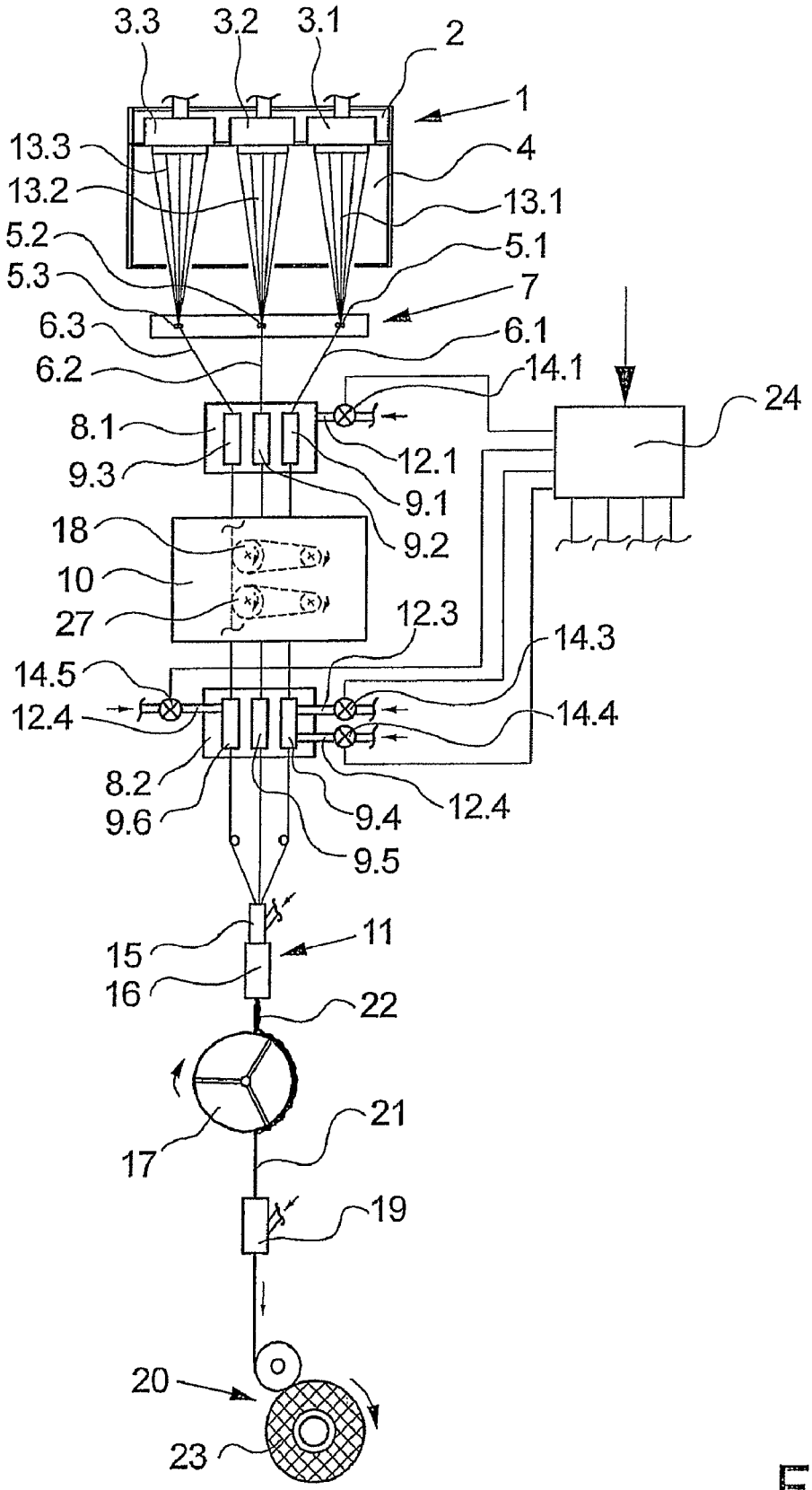
FIG. 2 is a schematic drawing of a second exemplary embodiment of the inventive apparatus.

FIG. 2 illustrates a second exemplary embodiment of an inventive apparatus for carrying out the inventive method. This embodiment is substantially the same as the above-described embodiment; accordingly, reference is made here to the description of that embodiment, and the emphasis hereinbelow will be on describing the differences. Components with identical functions have been assigned like reference numerals.

In the exemplary embodiment according to FIG. 2, the drawing device 10 may be comprised of, e.g., two galette units (18, 27) for drawing out, each of which is comprised of two driven galettes or a driven galette with an "overflow roll", wherewith the individual threads (6.1-6.3) are guided in parallel paths over the galettes. The galette units (18, 27) are driven at different speeds, causing stretching of the threads (6.1-6.3).

In order to provide a second pre-treatment stage wherein the individual threads (6.1-6.3) are prepared for the crimping, a second whirl-tangling unit 8.2 is provided between the drawing device 10 and the crimping device 11. The whirl-tangling unit 8.2 has a plurality of whirl-tangling nozzles (9.4-9.6), each of which is associated with a respective individual thread. These nozzles (9.4-9.6) are mutually independently controllable. Each of the whirl-tangling nozzles (9.4-9.6) has a respective compressed air feed (12.3-12.5) with respective pressure adjusting means (14.3-14.5), each of which pressure adjusting means is connected to the control device 24, which enables providing a set-point value for the pressure for each of the whirl-tangling nozzles (9.4-9.6). It should be noted that the pressure adjusting means (14.3-14.5) are devised such that they can completely shut off the compressed air feed. This provides a high degree of flexibility in the pre-treatment of the individual threads (6.1-6.3) immediately upstream of the crimping stage.

Thus it is seen that the exemplary embodiment for carrying out the inventive method as illustrated in the FIG. 2 has somewhat higher flexibility to attain particular effects in a compound thread comprised of the differently whirl-tangled individual threads (6.1-6.3). Thus, e.g., is it possible to produce a multicolored compound thread the appearance of which results from a strongly separated pair or trio of colors, resulting from, e.g. the use of three differently colored individual threads (6.1-6.3) wherewith one of the threads is subjected to whirl-tangling in the second pre-treatment stage and the other threads do not receive any additional whirl-tangling in said second pre-treatment stage.

Figure 3:
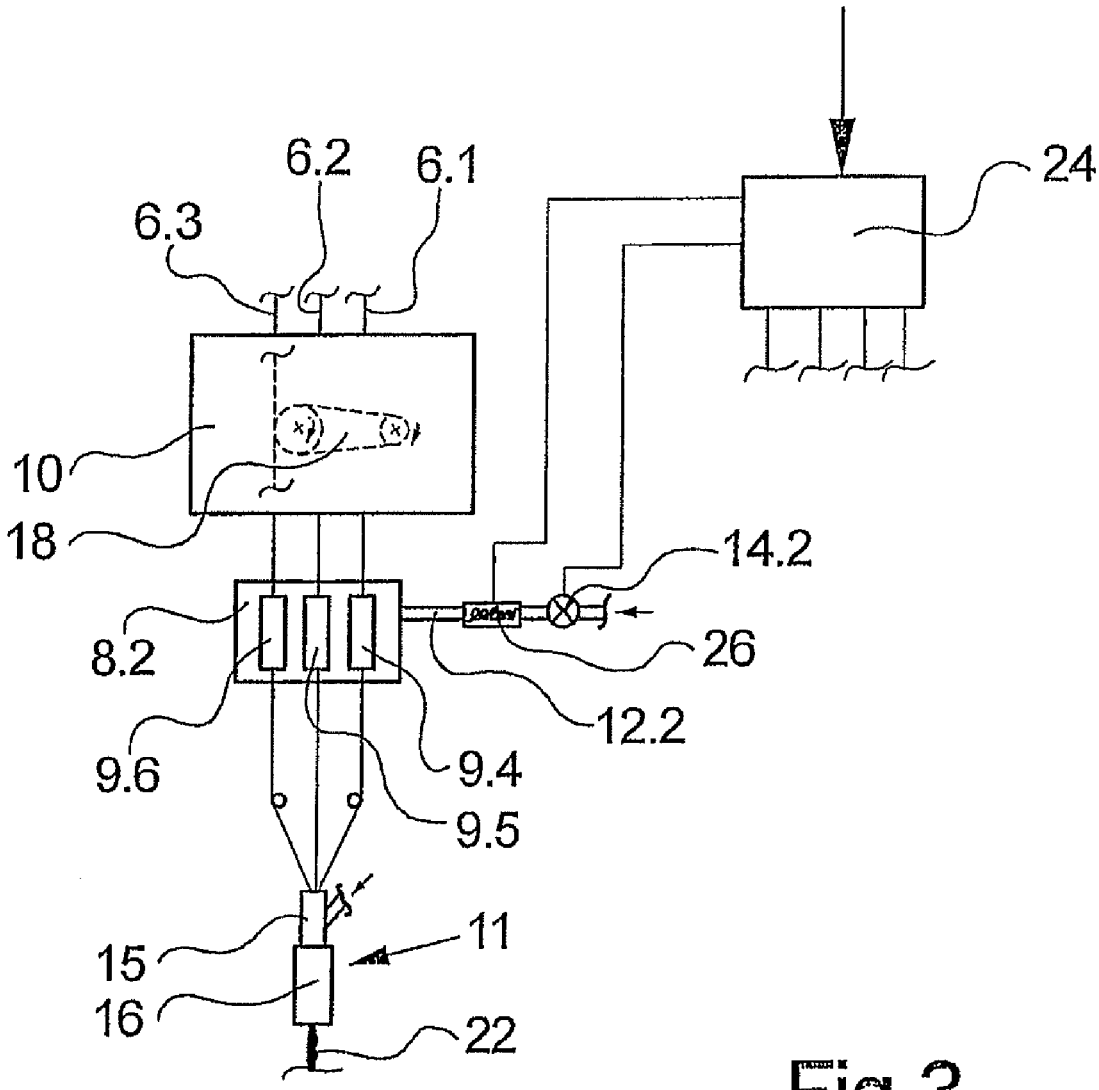
FIG. 3 is a schematic drawing of a variant of the exemplary embodiment of FIG. 1.

The exemplary embodiments of the inventive apparatus illustrated in FIGS. 1 and 3 can be varied by additional means, agents, and combinations, in order to, e.g., achieve special effects in the pre-treatment prior to the crimping of the individual threads. E.g., FIG. 3 shows a variant of the exemplary embodiment according to FIG. 1; in FIG. 3 only the drawing device 10, whirl-tangling unit 8.2, and crimping device 11 are illustrated (again, schematically). Since the components which are not illustrated are essentially identical to the corresponding components in FIG. 1, reference is made to here the preceding descriptions, and only the differences will be described hereinbelow.

For each of the threads (6.1-6.3), the whirl-tangling unit 8.2 has a respective whirl-tangling nozzle (9.4-9.6), connected to a pressure source via the compressed air supply line 12.2 and pressure adjusting means 14.2. The compressed air supply line 12.2 additionally has heating means 26, for preheating the fluid introduced via the whirl-tangling nozzles (9.4-9.6). The heating means 26 and pressure adjusting means 14.2 are connected to a control device 24.

In the exemplary embodiment illustrated in FIG. 3 the whirl-tangling of the individual threads (6.1-6.3) in the second pre-treating stage is accomplished with a heated fluid, which causes heating of the filaments of the individual threads. This heating influences the intermingling of the said individual filaments and leads to intensified crimping. This early intermingling substantially survives the subsequent processing.

Figure 4:
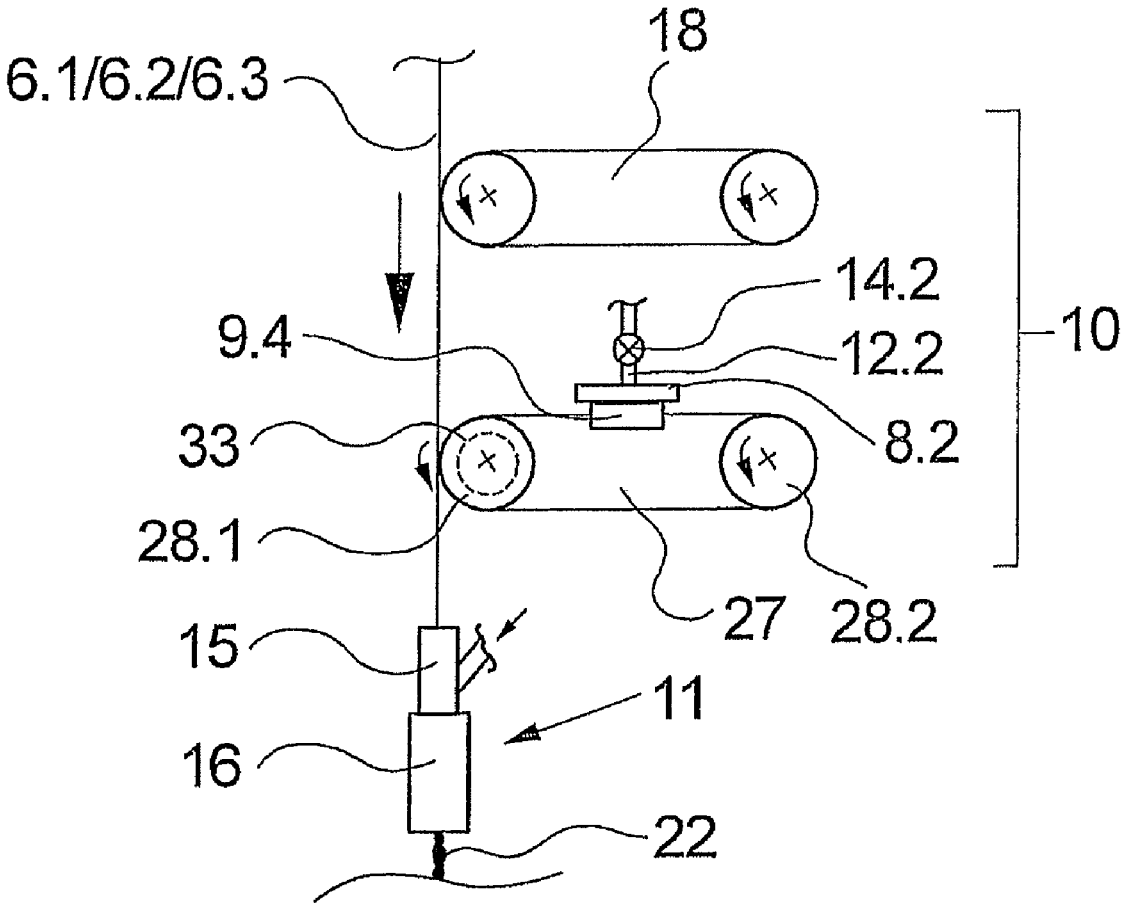
FIG. 4 is a schematic drawing of a variant of the exemplary embodiment of FIG. 2.

FIG. 4 is a detail view of a variant embodiment of the inventive apparatus according to FIG. 2. The structure and configuration of the process aggregate not shown is generally the same as in the preceding exemplary embodiment, and therefore does not require further description here. The drawing device 10, whirl-tangling unit 8.2, and crimping device 11 are included in the detail view shown in FIG. 4. The drawing device 10 is comprised of a first galette unit 18 configured for drawing and a second galette unit 27 configured for drawing, each of which has two galettes (28.1, 28.2) around which the individual threads (6.1-6.3) are passed multiple times. The galettes (28.1, 28.2) of the galette unit 27 are heated, so that the individual threads (6.1-6.3) on the periphery of the galettes (28.1, 28.2) undergo heating. The whirl-tangling unit 8.2 is disposed between the heated galettes (28.1, 28.2). This whirl-tangling unit 8.2 is identical to that of the exemplary embodiment illustrated in FIG. 2; each individual thread (6.1-6.3) is acted on by ("has associated with it") a respective whirl-tangling nozzle. The whirl-tangling unit 8.2 here is disposed in a segment of the threads between the galettes 28.1 and 28.2. E.g., the whirl-tangling unit 8.2 may be disposed in the last such segment of the individual threads (6.1-6.3).

After the individual threads (6.1-6.3) leave the heated galette, they are sent together to the crimping device 11 where they are compressed to form a thread plug 22.

In a variant of the inventive apparatus according to FIG. 4, the whirl-tangling of the heated individual threads can be carried out with the individual thread(s) being heated, and the tensioning of the individual threads as part of the texturizing of said threads in the crimping device 11 can be chosen to be independent of the tensioning of the individual threads in the whirl-tangling in the second pre-treating stage. Thus, e.g., a diameter step may be provided on the heated galette 28.1 to enable setting different tensioning values for the whirl-tangling. The diameter step 33 of the galette 28.1 in the last segment of the individual threads is shown as a dotted line in FIG. 4, and is implemented immediately downstream of the whirl-tangling unit 8.2. Another advantage of the variant illustrated in FIG. 4 is that the individual threads have a defined point of leaving from the galettes 28.1. The individual threads pass from the last galettes to the crimping device in a very smooth manner.

The arrangement illustrated in FIG. 4 may advantageously have galettes which are un-heated, wherewith the whirl-tangling is carried out at ambient temperature.

Figure 5:
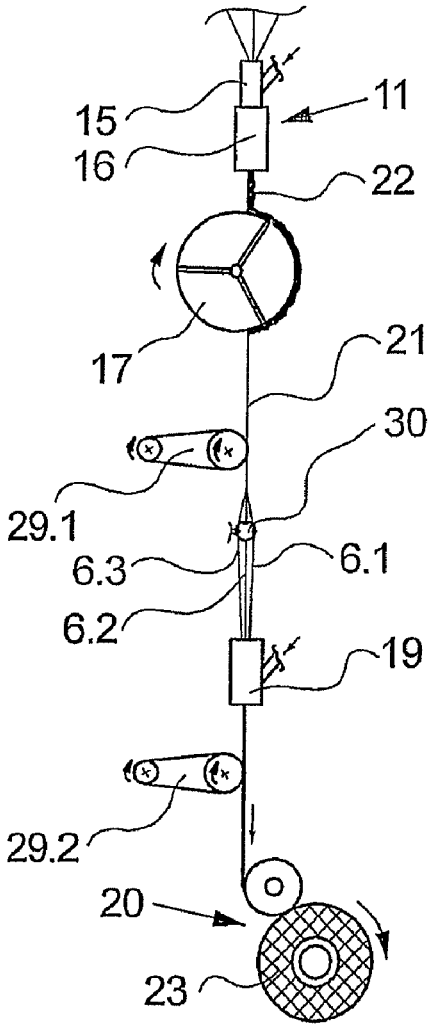
FIG. 5 is a schematic drawing of a variant of the exemplary embodiments of FIGS. 1 and 2.

FIG. 5 illustrates yet another exemplary embodiment of a variant method and apparatus applicable to the system according to FIGS. 1 and 2.

In the variant embodiment illustrated in FIG. 5, there are disposed between the cooling drum 17 and the winding device 20 a first drawing galette device 29.1, a separating thread guide 30, a "tangling device" 19, and a second drawing galette device 29.2. The components disposed upstream of the cooling drum 17 may be as in the exemplary embodiment according to FIG. 1 or 2, to which reference is made here.

In the variant embodiment illustrated in FIG. 5, the compound thread 21, after crimping and after cooling on the periphery of the cooling drum 17, is drawn off via the first galette device 29.1. The galette device 29.1 is shown here as a driven galette with an associated coordinated roll. For post-treatment, the compound thread 21 is separated into individual threads (6.1-6.3), by passing the individual threads through a separating thread guide 30 before they enter the tangling device 19. In the tangling device 19, the separately advancing individual threads (6.1-6.3) are once again subjected to whirl-tangling, and re-combined into a compound thread 21. The compound thread 21 is drawn off via the drawing galette 29.2 and is passed on to the winding device 20, where it is wound onto the bobbin 23. The separation of the compound thread prior to post-treatment allows production of additional special visual effects. In this connection it is possible that, prior to the post-treatment, at least one of the individual threads is subjected to additional treatment in the form of whirl-tangling, after said separation.

Figure 6:
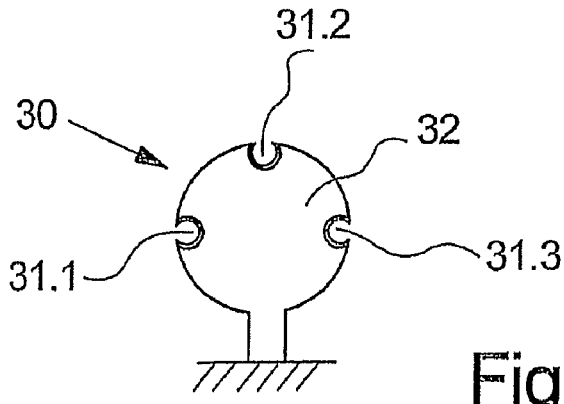
FIG. 6 is a schematic drawing of an exemplary embodiment of a separating thread guide.

In the variant embodiment illustrated in FIG. 5, the compound thread 21 is separated into the individual threads (6.1-6.3). In this, preferably a separating thread guide 30 is employed which preferably is configured according to the exemplary embodiment illustrated in FIG. 6. The separating thread guide 30 has a disc-shaped support member 32 which is fixed laterally to a machine frame. The support member 32 has a plurality of guiding eyes (31.1-31.3) on its periphery which are disposed at mutual distances apart. In the embodiment illustrated in FIG. 6, these eyes (31.1-31.3) are disposed at the apices of an equilateral triangle. Preferably each such eye has a ceramic insert, which enables the individual threads (6.1-6.3) to be separately fed to the tangling device 19, in this embodiment.

The described exemplary embodiments for carrying out the inventive method are in the nature of examples, in their arrangements and in the choice of processing devices. Thus, additional pre-treatment and post-treatment stages and means may be introduced, e.g. for the purpose of subjecting the individual threads to additional treatments prior to texturizing, or subjecting the compound thread to additional treatments after the texturizing, etc. Likewise the characteristics and form of the crimping device are in the nature of examples. To realize particular crimping characteristics, the individual threads may be texturized using different parameters. Separately performed crimping also enables the use of different crimping methods, wherewith the crimped individual threads will then be combined into a compound thread. The number of individual threads illustrated in the exemplary embodiments is, of course, in the nature of an example. A compound thread may be formed from two or more individual threads.

That which is claimed is:

1. An apparatus for manufacturing a crimped compound thread, comprising:

a spinning device, a cooling device, and a drawing device, for producing a plurality of multifilament individual threads;

a crimping device whereby the individual threads are combined into a compound thread; and a plurality of whirl-tangling units comprising a first and a second whirl tangling unit disposed upstream of the crimping device, for separately subjecting the individual threads to whirl-tangling disposed in succession in a path of advance of the individual threads, wherein for multiple whirl-tangling of at least one of the individual threads, the first whirl-tangling unit is disposed upstream of the drawing device, wherewith said first whirl-tangling unit has a respective whirl-tangling nozzle for each of the individual threads, and wherein the second whirl-tangling unit is disposed downstream of the drawing device, wherewith said second whirl-tangling unit has a respective whirl-tangling nozzle for each of the individual threads.

2. An apparatus according to claim 1, wherein the second whirl-tangling unit is disposed downstream of the drawing device, and wherein the second whirl-tangling unit has a plurality of whirl-tangling nozzles.

3. An apparatus according to claim 1, wherein the whirl-tangling nozzles of the first whirl-tangling unit have a controllable compressed air supply.

4. An apparatus according to claim 2, wherein the whirl-tangling nozzles of the second whirl-tangling unit have a plurality of separately controllable compressed air supplies.

5. An apparatus according to claim 1, wherein at least one of the whirl-tangling units has a heating means whereby compressed air can be heated.

6. An apparatus according to claim 1, wherein at least one of the whirl-tangling units has a heating device disposed upstream of the at least one whirl-tangling unit, whereby the individual threads can be heated.

7. An apparatus according to claim 2, wherein the drawing is comprised of a galette unit disposed upstream of the crimping device, wherewith the individual threads are guided over said galette unit in multiple loops; and wherein the whirl-tangling nozzles of the second whirl-tangling unit are arranged such that the individual threads can be subjected to whirl-tangling prior to leaving the galette unit.

8. An apparatus according to claim 7, wherein the galette unit is comprised of two driven galettes, wherewith at least one of said galettes has a diameter step which is operative downstream of the whirl-tangling unit.

9. An apparatus according to claim 7, wherein the galette unit is comprised of two driven galettes, wherewith at least one of said galettes is configured so as to be heatable.

10. An apparatus according to claim 1, wherein the crimping device is followed by a winding device for winding the compound thread onto a bobbin or the like, and wherein a tangling device is disposed between the crimping device and the winding device, for tangling the compound thread.

11. An apparatus according to claim 1, wherein the crimping device comprises an advancing nozzle arid an associated crimping chamber, wherewith the individual threads are advanced as a group into the crimping chamber by means of the advancing nozzle.

* * * * *

UNITED STATES PATENT AND TRADEMARK OFFICE

CERTIFICATE OF CORRECTION

PATENT NO. : 8,398,389 B2
APPLICATION NO. : 11/833434
DATED : March 19, 2013
INVENTOR(S) : Stündl It is certified that error appears in the above-identified patent and that said Letters Patent is hereby corrected as shown below:

In the Specifications:

Column 4,
Line 3, "pretreatment" should read --pre-treatment--.

Signed and Sealed this
Second Day of July, 2013

Teresa Stanek Rea
*Acting Director of the United States Patent and Trademark Office*